US010765271B2

(12) United States Patent
Rushing

(10) Patent No.: US 10,765,271 B2
(45) Date of Patent: Sep. 8, 2020

(54) SANITIZING DEVICE WITH A REMOVABLY ATTACHED BRUSH COMPONENT

(71) Applicant: Sandy Everett Rushing, Terry, MS (US)

(72) Inventor: Sandy Everett Rushing, Terry, MS (US)

( * ) Notice: Subject to any disclaimer, the term of this patent is extended or adjusted under 35 U.S.C. 154(b) by 89 days.

(21) Appl. No.: 15/911,472

(22) Filed: Mar. 5, 2018

(65) Prior Publication Data

US 2019/0269281 A1 Sep. 5, 2019

(51) Int. Cl.

*A47K 7/02* (2006.01)
*A46B 5/00* (2006.01)
*A47L 23/22* (2006.01)

(52) U.S. Cl.

CPC ..... *A47K 7/026* (2013.01); *A46B 5/0008* (2013.01); *A46B 5/0095* (2013.01); *A47K 7/028* (2013.01); *A46B 2200/1006* (2013.01); *A46B 2200/306* (2013.01); *A47L 23/22* (2013.01)

(58) Field of Classification Search

CPC ..... A47K 7/026; A47K 7/028; A47L 23/22; A46B 2200/1006; A46B 2200/306; A46B 17/02; A46B 2200/405; A46B 15/0097; A46B 5/0008; A46B 5/0095

USPC ..... 15/161, 159.1–160

See application file for complete search history.

(56) References Cited

U.S. PATENT DOCUMENTS

| | | | |
|---|---|---|---|
| 3,276,060 A | 10/1966 | Stokes, Jr. et al. | |
| 3,973,286 A | 8/1976 | Logan | |
| 4,256,409 A | 3/1981 | Manley | |
| 4,532,668 A | 8/1985 | Slonicki | |
| 5,177,829 A | 1/1993 | Simpson | |
| 5,224,234 A | 7/1993 | Aesenault et al. | |
| 5,321,867 A | 6/1994 | Probst | |
| 5,444,888 A | 8/1995 | Withey | |
| 5,560,068 A | 10/1996 | Blake | |
| 5,724,695 A | 3/1998 | Galizia | |
| 6,253,407 B1 | 7/2001 | Bjelkevig | |
| 6,733,595 B1 | 5/2004 | Grillo | |
| 7,028,362 B2 | 4/2006 | Davallou | |
| 7,310,850 B2 | 12/2007 | Ge | |
| 9,307,872 B2 | 4/2016 | Jorgensen | |
| 2010/0088816 A1 | 4/2010 | Rollins | |

(Continued)

FOREIGN PATENT DOCUMENTS

| | | | | |
|---|---|---|---|---|
| DE | 10 2011 010 766 A1 | | 8/2012 | |
| GB | 523744 A | * | 7/1940 | ..... A47L 23/22 |
| GB | 2206780 A | * | 1/1989 | ..... A47L 23/22 |

*Primary Examiner* — Laura C Guidotti

(74) *Attorney, Agent, or Firm* — Sughrue Mion, PLLC

(57) ABSTRACT

A device may include a handle component that is configured to permit a user to grasp the handle component during a sanitation process of the user wherein the user sanitizes a distal appendage using the device. The device may include a shaft component that extends in a vertical direction and that is configured to connect the handle component and a connection component. The device may include the connection component that is configured to removably adhere to a surface to permit the device to remain substantially stationary during the sanitation process of the user. The device may include a brush component that is configured to permit the user to perform the sanitation process of the user and that is removably connected to the connection component.

17 Claims, 4 Drawing Sheets

(56) References Cited

U.S. PATENT DOCUMENTS

| | | | |
|---|---|---|---|
| 2011/0035894 | A1 | 2/2011 | Goldhammer |
| 2015/0026903 | A1 | 1/2015 | Holley |

* cited by examiner

SANITIZING DEVICE WITH A REMOVABLY ATTACHED BRUSH COMPONENT

FIELD

Apparatuses and devices consistent with example embodiments relate to a sanitizing device comprising a handle component, a shaft component that extends in a vertical direction to connect the handle component and a connection component, the connection component to adhere to a surface and to permit stabilization during operation, and a brush component that is removably connected to the connection component to permit a user to sanitize a distal appendage while grasping the handle component.

BACKGROUND

A user can use a sanitizing device when performing a sanitation process of the user. For example, a user may use a brush, a sponge, a cloth, etc. to sanitize an appendage of the user such as a foot, a toe, a leg, etc.

SUMMARY

According to some possible implementations, a device may include a handle component that is configured to permit a user to grasp the handle component during a sanitation process of the user wherein the user sanitizes a distal appendage using the device. The device may include a shaft component that extends in a vertical direction and that is configured to connect the handle component and a connection component. The device may include the connection component that is configured to removably adhere to a surface to permit the device to remain substantially stationary during the sanitation process of the user. The device may include a brush component that is configured to permit the user to perform the sanitation process of the user and that is removably connected to the connection component.

According to some possible implementations, a system may include a handle component that is configured to permit a user to grasp the handle component during a sanitation process of a distal appendage of the user. The system may include a shaft that extends in a vertical direction and that is configured to connect the handle component and a connection component. The system may include the connection component that is configured to adhere to a surface to permit the system to remain substantially stationary during the sanitation process. The system may include a brush component that is configured to permit the user to perform the sanitation process of the user and that is connected to the connection component.

According to some possible implementations, a sanitizing apparatus may include a handle component that is configured to permit a user to grasp the handle component during a sanitation process of a foot of the user. The sanitizing apparatus may include a shaft component that extends in a vertical direction and that is configured to connect the handle component and a connection component. The sanitizing apparatus may include the connection component that is configured to removably adhere to a surface to permit the sanitizing apparatus to remain substantially stationary during the sanitation process of the foot of the user. The sanitizing apparatus may include a brush component that is configured to permit the user to perform the sanitation process of the foot, leg, toes, etc. of the user and that is removably connected to the connection component.

DETAILED DESCRIPTION OF THE PREFERRED EMBODIMENTS

The following detailed description of example implementations refers to the accompanying drawings. The same reference numbers in different drawings may identify the same or similar elements.

A user can use a hand-held device such as a brush having bristles, a sponge, a cloth, etc. to sanitize a distal appendage of the user such as a foot, a toe, a leg, etc. For example, the user may apply a sanitizing agent, such as soap, to the hand-held device and sanitize the appendage using the sanitizing device. However, this operation requires the user to bend at the waist, or squat, to reach the distal appendage. Alternatively, the user can lift the distal appendage, which thereby requires the user to balance on a single foot. In all of those cases, the user's risk of falling is greatly enhanced. Similarly, particular users (e.g., elderly persons, pregnant women, persons suffering from ailments, etc.) may be incapable of performing the foregoing operations.

Some implementations described herein provide a sanitizing device that permits a user to sanitize distal appendages without requiring the user to bend at the waist, without requiring the user to balance on a single foot or leg, without requiring that the user operate the sanitizing device with a hand, among other things. Additionally, some implementations described herein provide a sanitizing device that permits a user to grasp a handle during operation of the sanitizing device.

In this way, some implementations described herein provide a sanitizing device that improves safety of the user during operation, that permits users with limited mobility to sanitize themselves, that is modular, that reduces harboring of bacteria, mold, fungi, etc., that includes improved sturdiness, that offers reduced required assembly, that is low cost, among many other benefits.

Figure 1:
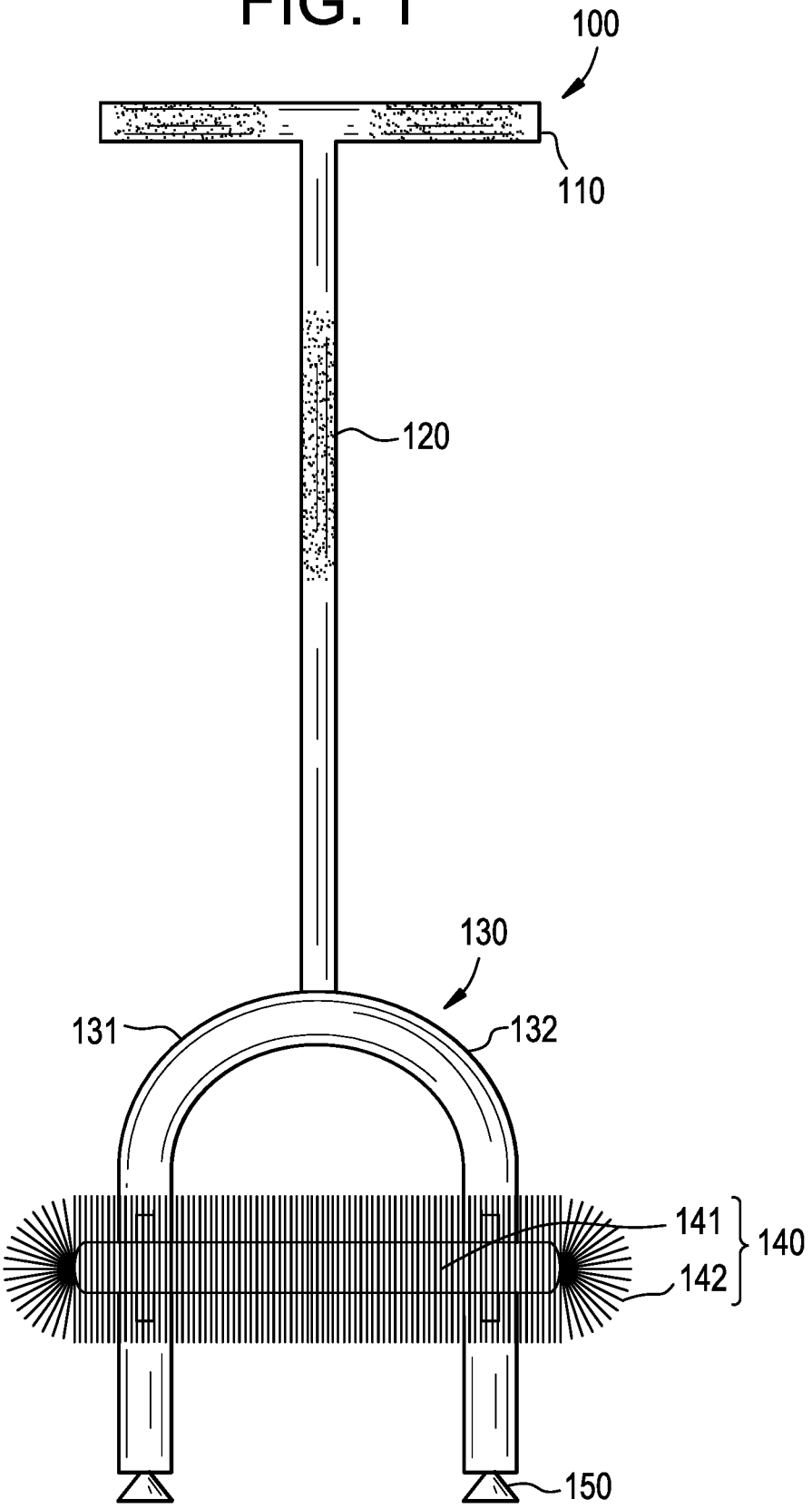
FIG. 1 is a diagram of an example sanitizing device described herein.

FIG. 1 is a diagram of an example sanitizing device 100 described herein. As shown in FIG. 1, sanitizing device 100 may include a handle component 110, a shaft component 120, a connection component 130, a primary brush component 140, and an adherence component 150. Sanitizing device 100 may be configured to permit a user to perform a sanitation process of the user. In other words, a user may sanitize a distal appendage (e.g., a foot, a leg, a heel, a toe, etc.) of the user using sanitizing device 100.

Handle component 110 may include a component that is configured to permit a user to grasp handle component 110 during a sanitation process of the user. Handle component 110 may be comprised of any suitable material such as polycarbonate plastic, polyethylene plastic, polypropylene plastic, polystyrene plastic, an aluminum alloy, a titanium alloy, a carbon fiber plastic, and/or the like.

Handle component 110 may include any suitable dimensions to permit a user to grasp handle component 110. As a particular and non-limiting example, handle component 110 may include a width, in a horizontal direction shown in FIG. 1, of nine inches, and include a substantially circular cross-section including a diameter of one inch. Handle component 110 may include a surface coating and/or a surface property to provide any suitable texture such as a smooth texture, a coarse texture, an abrasive texture, a rubberized texture, etc.

Shaft component 120 may include a component that extends in a vertical direction and that is configured to connect handle component 110 and connection component 130. Shaft component 120 may be comprised of any suitable material, and include any suitable dimensions. As a particular example, shaft component 120 may include a height, in a vertical direction shown in FIG. 1, of twenty five inches, and include a substantially circular cross-section including a diameter of one inch.

Shaft component 120 may be selectively adjustable to permit a height of shaft component 120 to be adjusted. For example, shaft component 120 may include telescoping functionality. Alternatively, shaft component 120 may include a set of components that permits the height of shaft component 120 to be adjusted based on insertion and/or removal of the components.

Connection component 130 may include a component that is configured to removably adhere to a surface to permit sanitizing device 100 to remain substantially stationary during the sanitation process of the user. Additionally, connection component 130 may include a component that is configured to permit primary brush component 140 and/or secondary brush component 160 to be removably attached to connection component 130.

Connection component 130 may be comprised of any suitable material, and include any suitable dimensions. As a particular example, connection component 130 may include a height, in the vertical direction shown in FIG. 1, of eleven inches, and a width, in the horizontal direction shown in FIG. 1, of five and one half inches.

As shown in FIG. 1, connection component 130 may include a substantially arched shape. For example, as shown in FIG. 1, connection component 130 may include a first portion 131 that extends to a left side in the horizontal direction shown in FIG. 1, and a second portion 132 that extends to a right side in the horizontal direction shown in FIG. 1. Collectively, the first portion 131 and the second portion 132 may form a substantially arched shape including a space formed between first portion 131 and second portion 132 to accommodate an appendage of the user, as described elsewhere herein.

Primary brush component 140 may include a component that is configured to permit the user to perform the sanitation process of the user. As shown in FIG. 1, primary brush component 140 may include a primary core component 141 and a primary bristle component 142.

Primary core component 141 may include a component that permits primary brush component 140 to connect to connection component 130, and that accommodates primary bristle component 142. Primary core component 141 may be comprised of any suitable material and include any suitable dimensions. Primary core component 141 may include a similar stiffness as compared to connection component 130. Alternatively, primary core component 141 may be less stiff than as compared to connection component 130 to facilitate connection of primary core component 141 to connection component 130.

Primary bristle component 142 may include a component including a set of bristles. Primary bristle component 142 may include any suitable material such as a nylon, a plastic, a synthetic polymer, and/or the like, to permit a user to sanitize an appendage by interacting with the bristles of primary bristle component 142. Collectively, primary core component 141 and primary bristle component 142 may include a width, in the horizontal direction shown in FIG. 1, of nine and one half inches. Primary bristle component 142 may include any bristle stiffness and/or texture to permit the user to sanitize a distal appendage.

Primary core component 141 may be removably connected to connection component 130. Primary core component 141 may connect to connection component 130 at a middle portion of connection component 130 in the vertical direction shown in FIG. 1. For example, a height between a surface, to which sanitizing device 100 is adhered, and a middle portion of primary core component 141 may be five and one half inches, and a height between the middle portion of primary core component 141 and a top of connection component 130 may be five and one half inches. In this way, connection component 130 and primary brush component 140 may be configured to accommodate an appendage of the user via the space between first portion 131 and second portion 132 of connection component 130.

Adherence component 150 includes a component that is configured to removably adhere to a surface to permit sanitizing device 100 to remain substantially stationary during the sanitation process of the user. For example, adherence component 150 may include a suction device that utilizes a negative fluid pressure of air or water to adhere to a surface. Adherence component 150 may be comprised of any suitable material such as a silicone, a plastic, a rubber, and/or the like.

As used herein, the surface, to which sanitizing device 100 is adhered, may be a surface of a shower, a surface of bathtub, and/or the like. It should be understood that sanitizing device 100 may be used at various locations, and thereby is capable of being adhered to myriad surfaces.

While FIG. 1 depicts a set of adherence components 150, it should be understood that any number of adherence components 150 may be used. For example, sanitizing device 100 may include three adherence components 150, four adherence components 150, six adherence components 150, etc. In this way, the stability of sanitizing device 100 may be improved by utilizing additional adherence components 150.

In some implementations, handle component 110, shaft component 120, connection component 130, primary brush component 140, and adherence component 150 may be a single unitary component. In other words, the foregoing components may be formed as a single component.

Alternatively, handle component 110, shaft component 120, connection component 130, primary brush component 140, adherence component 150, and/or one or more combinations thereof may be a single unitary component. In other words, any of the foregoing components, or a combination of the foregoing components, may be removably connected to another component, or a combination thereof, of the set of foregoing components. As such, modularity of sanitizing device 100 may permit selective replacement of any of the foregoing components.

Any of the foregoing components may be connected via connection mechanisms such as connectors, inserts, threads, pins, coupling members, and/or the like. Additionally, or alternatively, any of the foregoing components may connect via press-fit, friction-fit, and/or the like. The connection mechanisms may be configured to reduce an amount of movement of various components of sanitizing device 100 in relation to one another, and may reduce an amount of movement of sanitizing device 100 during operation of sanitizing device 100. In this way, sanitizing device 100 may remain substantially stationary during operation, thereby improving safety of the user, efficacy of sanitizing device 100, and/or the like.

Further, it should be understood that dimensions of sanitizing device 100 may be modified to accommodate a specific need of a user. For example, the user may adjust a height of sanitizing device 100, a width of connection component 130, a position of primary brush component 140, and/or the like, based on the particular needs of the user.

During a sanitation process of the user, the user may manipulate sanitizing device 100 to adhere sanitizing device 100 to a surface. For example, the user may manipulate sanitizing device 100 to adhere adherence component 150 to a surface of a shower, a bathtub, and/or the like (e.g., an area where the user intends to perform the sanitation process).

Further, the user may apply a sanitizing agent (e.g., a soap, a lotion, a solution, and/or the like) to an appendage of the user that the user desires to sanitize, such as a foot, a lower leg portion, and/or the like. Additionally, the user may apply a sanitizing agent to primary brush component 140. Further still, the user may apply water to the appendage to be sanitized to permit the sanitizing agent to sanitize the appendage, to improve spreading of the sanitizing agent, and/or remove the sanitizing agent from the appendage.

The user may grasp handle component 110, and place the appendage to be sanitized through a space formed by connection component 130. For example, the user may place a foot of the user through the space formed between primary brush component 140 and the top of connection component 130 and between first portion 131 and second portion 132 of connection component 130. In this case, the user may sanitize a bottom of the foot of the user by placing the foot on top of primary brush component 140, and moving the foot across primary bristle component 142 of primary brush component 140.

As another example, the user may place the foot of the user through another space formed between a bottom of primary brush component 140 and the surface to which sanitizing device 100 is removably adhered. In this case, the user may sanitize a top of the foot of the user by placing the foot underneath primary brush component 140, and moving the top of the foot across primary bristle component 142. Similarly, the user may sanitize a portion of a leg by placing the portion of the leg in contact with primary brush component 140, and moving the portion of the leg in relation to primary brush component 140.

It should be understood that the user may interact with sanitizing device 100 in numerous other ways to sanitize various appendages and/or portions of appendages.

By grasping handle component 110, the user may improve balance of the user, safety of the user, efficacy of sanitizing device 100, and/or the like, during operation of sanitizing device 100. In this way, some implementations described herein improve user safety, improve sanitation of the user, reduce an amount of time associated with sanitizing the user, and/or the like.

While a particular configuration is shown and/or described in association with FIG. 1, it should be understood that implementations described herein are applicable to other configurations than as shown in FIG. 1.

Figure 2:
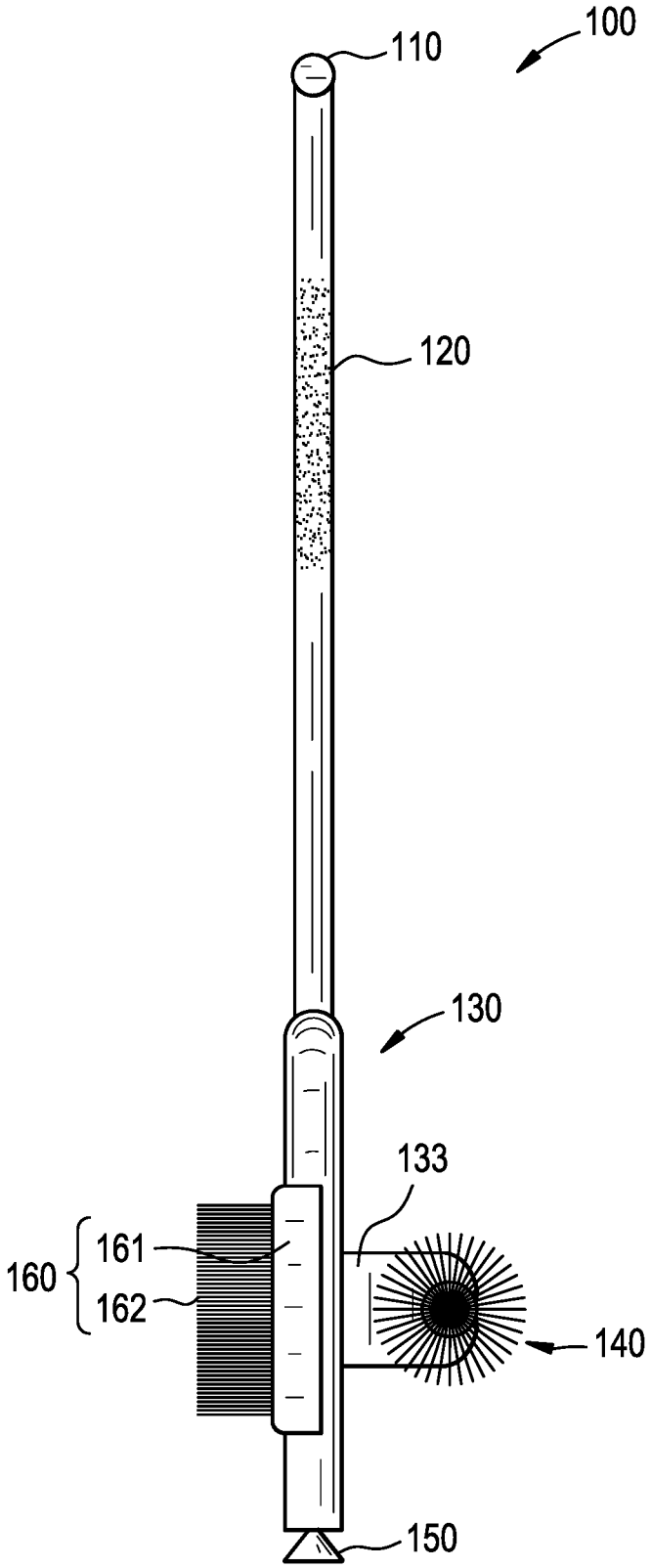
FIG. 2 is a side view of the example sanitizing device described herein.

FIG. 2 is a side view of the example sanitizing device 100 described herein. As shown in FIG. 2, sanitizing device 100 may further include a secondary brush component 160. Secondary brush component 160 may include a component that is configured to connect to connection component 130 to permit a user to sanitize an appendage. For example, secondary brush component 160 may be removably connected to connection component 130.

Secondary brush component 160 may include a secondary core component 161 and a secondary bristle component 162. As similar to primary core component 141, secondary core component 161 may be comprised of any suitable material, and include any suitable dimensions to permit secondary core component 161 to connect to connection component 130. Further, as similar to primary bristle component 142, secondary bristle component 162 may be comprised of any suitable material, and include any suitable dimensions to permit a user to sanitize an appendage. Secondary bristle component 162 may include bristles that are the same type, stiffness, size, etc. as bristles of primary bristle component 142, that differ from bristles of primary bristle component 142, and/or the like.

As further shown in FIG. 2, connection component 130 may include an extension section 133 that extends in a horizontal direction shown in FIG. 2. (e.g., to a right side in FIG. 2). As a particular example, extension section 133 may extend two and one half inches in a horizontal direction. As shown, and as described in more detail in association with FIGS. 4 and 7, primary brush component 140 may connect to connection component 130 via extension section 133. In this way, primary brush component 140 may extend to a first side of sanitizing device 100 based on being connected to extension section 133. For example, primary brush component 140 may be laterally offset to permit a user to more effectively sanitize myriad portions of distal appendages.

As further shown in FIG. 2, secondary brush component 160 may extend to another side of sanitizing device 100, such as the left side as shown in FIG. 2, as compared to primary brush component 140. In this way, a user may interact with primary brush component 140 without having secondary brush component 160 interfere, and may also interact with secondary brush component 160 without having primary brush component 140 interfere. Alternatively, primary brush component 140 and secondary brush component 160 may extend to a same lateral side of sanitizing device 100.

As further shown in FIG. 2, primary brush component 140 may be disposed substantially horizontally to thereby permit primary brush component 140 to be substantially parallel to a surface to which sanitizing device 100 is adhered. Further, secondary brush component 160 may be disposed substantially vertically to thereby permit secondary brush component 160 to be substantially perpendicular to the surface to which sanitizing device 100 is adhered. In this way, some implementations described herein permit a user to interact with primary brush component 140 to sanitize a bottom of a foot, a top of a foot, a heel of a foot, a portion of a leg, and/or the like, and interact with secondary brush component 160 to sanitize toes, a space between toes, and/or the like. In other words, a user may perform different types of motions of an appendage to interact with primary brush component 140 and secondary brush component 160 to sanitize appendages in different ways.

While a particular configuration is shown and/or described in association with FIG. 2, it should be understood that implementations described herein are applicable to other configurations than as shown in FIG. 2.

Figure 3:
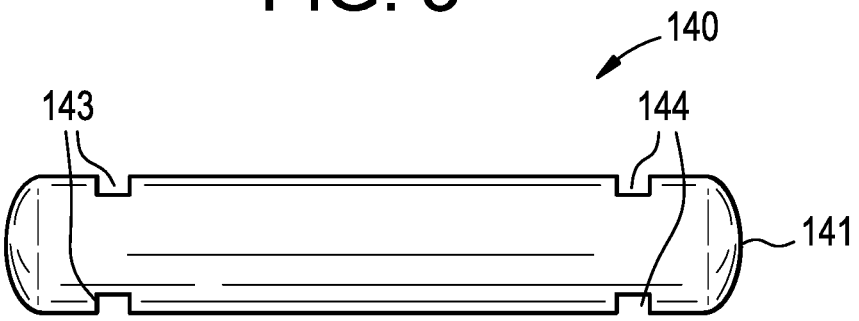
FIG. 3 is a diagram of an example primary core component of a primary brush component described herein.

FIG. 3 is a diagram of an example primary core component 141 of a primary brush component 140 described herein. As shown in FIG. 3, primary core component 141 may include a first set of indents 143, and a second set of indents 144.

The first set of indents 143 may be configured to permit primary core component 141 to connect to connection component 130. Further, the second set of indents 144 may be configured to permit primary core component to connect to connection component 130.

As shown in FIG. 3, the first set of indents 143 and the second set of indents 144 may include a substantially square shape. In this way, movement of primary core component 141 in relation to connection component 130 is reduced, thereby improving stabilization of sanitizing device 100 during operation.

The first set of indents 143 may interface with first portion 131 of connection component 130, and the second set of indents 144 may interact with second portion 132 of connection component 130. For example, primary core component 141 may be inserted into a space formed by connection component 130, as described in more detail in association with FIG. 4 below, and be retained by connection component 130 via the first set of indents 143 and the second set of indents 144.

While a particular configuration is shown and/or described in association with FIG. 3, it should be understood that implementations described herein are applicable to other configurations than as shown in FIG. 3.

Figure 4:
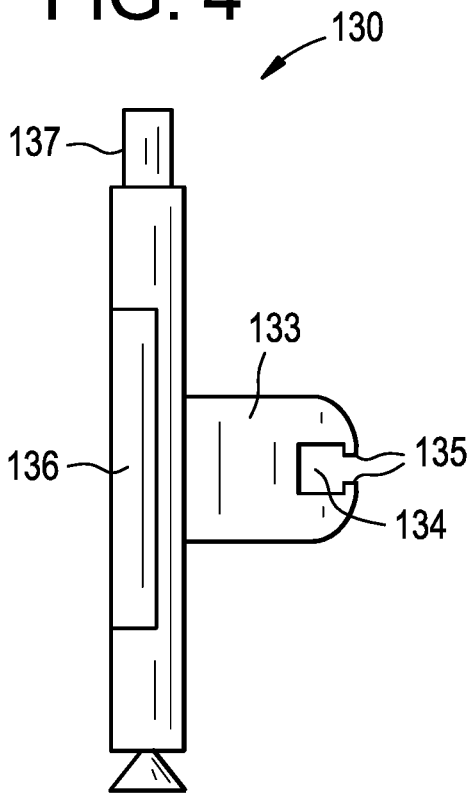
FIG. 4 is a side view of an example connection component described herein.

FIG. 4 is a side view of an example connection component 130 described herein. As shown in FIG. 4, connection component 130 may include extension section 133, a primary connection component 134, a set of retaining components 135, a secondary connection component 136, and a shaft connection component 137.

It should be understood that connection component 130 includes first portion 131 and second portion 132. As such, FIG. 4 may represent a view of either first portion 131 or second portion 132. Additionally, each of first portion 131 and second portion 132 may include respective extension sections 133, primary connection components 134, retaining components 135, and/or secondary connection component 136. Alternatively, sanitizing device 100 may include a single secondary connection component 136 that is provided on either first portion 131 or second portion 132. That is, a single secondary brush component 160 may attach to connection component 130, thereby requiring a single secondary connection component 136.

As shown in FIG. 4, extension section 133 may extend in a horizontal direction, and may include primary connection component 134 and retaining components 135. In this way, primary brush component 140 may be laterally offset in relation to connection component 130 (e.g., first portion 131 or second portion 132 of connection component 130). Primary connection component 134 may be configured to accommodate primary core component 141. For example, primary connection component 134 may accommodate primary core component 141 via a space formed by primary connection component 134 shown in FIG. 4. The first set of indents 143 and the second set of indents 144 of primary core component 141 may be configured to mate with primary connection component 134 to thereby permit primary core component 141 to be attached to connection component 130. Further, retaining components 135 may improve retention of primary core component 141 while primary core component 141 is attached to connection component 130 via primary connection component 134. In some implementations, the first set of indents 143 and the second set of indents 144 may include substantially square shapes, thereby reducing an amount of translation between primary core component 141 and primary connection component 134.

As further shown in FIG. 4, secondary connection component 136 may extend substantially vertically in association with connection component 130 to accommodate secondary brush component 160. In some implementations, secondary connection component 136 may be indented in relation to connection component 130 to permit attachment of secondary brush component 160. In other words, a surface of secondary connection component 136 may be indented, recessed, etc. in relation to a surface of connection component 130.

As further shown in FIG. 4, shaft connection component 137 may be configured to connect connection component 130 and shaft component 120. For example, as shown, shaft connection component 137 may include a male connector that is configured to interface with a corresponding female connector of shaft component 120. Further, the male connector of shaft connection component 137 may be substantially square in shape, and may correspond to a substantially square female connector of shaft component 120. In this way, an amount of translation (e.g., rotation) between connection component 130 and shaft component 120 may be reduced.

While a particular configuration is shown and/or described in association with FIG. 4, it should be understood that implementations described herein are applicable to other configurations than as shown in FIG. 4.

Figure 5:
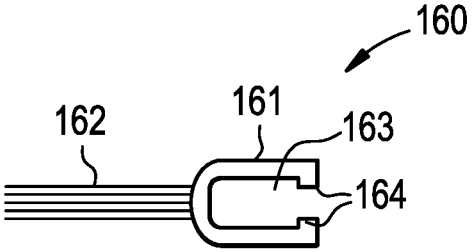
FIG. 5 is a top view of an example secondary brush component described herein.

FIG. 5 is a top view of an example secondary brush component 160 described herein. As shown in FIG. 5, secondary brush component 160 may include a secondary core component 161, a secondary bristle component 162, a retention space 163, and a set of retention components 164.

Secondary brush component 160 may be formed to include retention space 163. In this way, secondary brush component 160 may connect to secondary connection component 136 via retention space 163. Further, retention components 164 may improve retention and connection of secondary brush component 160 and connection component 130. Retention components 164 may interface with a recessed portion of secondary connection component 136, detents of secondary connection component 136, and/or the like.

As shown in FIG. 5, secondary bristle components 162 may extend laterally in a horizontal direction shown in FIG. 5. As a particular example, secondary bristle components 162 may extend one and one half inches in the horizontal direction.

While a particular configuration is shown and/or described in association with FIG. 5, it should be understood that implementations described herein are applicable to other configurations than as shown in FIG. 5.

Figure 6:
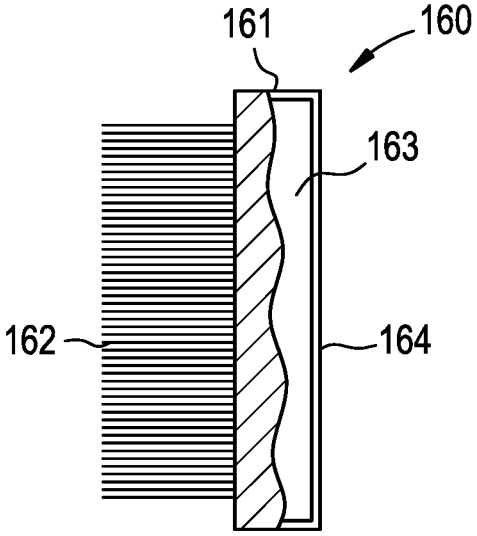
FIG. 6 is a side view of the example secondary brush component described herein.

FIG. 6 is a side view of the example secondary brush component 160 described herein. For example, FIG. 6 depicts a partial cut-away view of secondary brush component 160.

As shown in FIG. 6, secondary brush component 160 may include secondary bristle component 162 that extends vertically in a vertical direction shown in FIG. 6. As a particular example, secondary brush component 160 may include a height of five inches.

While a particular configuration is shown and/or described in association with FIG. 6, it should be understood that implementations described herein are applicable to other configurations than as shown in FIG. 6.

Figure 7:
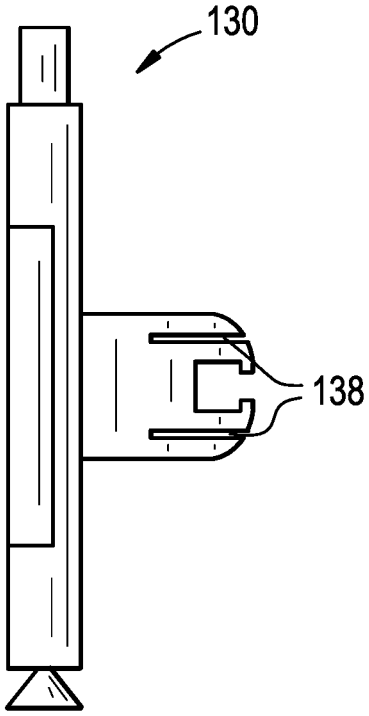
FIG. 7 is a side view of the example connection component described herein.

FIG. 7 is a side view of the example connection component 130 described herein. As shown in FIG. 7, connection component 130 may further include flexion slots 138.

Flexion slots 138 may include slots formed in extension section 133 of connection component 130. Flexion slots 138 may be configured to permit primary core component 141 of primary brush component 140 to connect to primary connection component 134. For example, flexion slots 138 may improve the ease at which primary core component 141 is connected to primary connection component 134, and improve retention of primary core component 141 during operation of sanitizing device 100 by permitting translation of primary connection component 134 in relation to extension section 133.

While a particular configuration is shown and/or described in association with FIG. 7, it should be understood that implementations described herein are applicable to other configurations than as shown in FIG. 7.

The foregoing disclosure provides illustration and description, but it is not intended to be exhaustion or to limit the implementations to the precise form disclosed. Modifications and variations are possible in light of the above disclosure or may be acquired from practice of the implementations.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No functionality used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items (e.g., related items, unrelated items, a combination of related and unrelated items, etc.), and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A device, comprising:

a handle component that is configured to permit a user to grasp the handle component during a sanitation process of the user wherein the user sanitizes a distal appendage using the device;

a shaft component that extends in a vertical direction and that is configured to connect the handle component and a connection component;

the connection component that comprises a first portion and a second portion that extend in the vertical direction to form a space that is capable of accommodating the distal appendage of the user, and that is configured to removably adhere to a surface to permit the device to remain substantially stationary during the sanitation process of the user; and a brush component that is configured to permit the user to perform the sanitation process of the user and that is removably connected to the first portion and the second portion of the connection component via friction fit, wherein the brush component extends laterally in a horizontal direction beyond the first portion and the second portion, and wherein the brush component is offset from the space in a direction orthogonal to the horizontal direction.

2. The device of claim 1, further comprising:

another brush component that is configured to permit the user to perform the sanitation process of the user and that is removably connected to the connection component.

3. The device of claim 1, further comprising:

a set of adherence components configured to removably adhere to the surface to permit the device to remain substantially stationary during the sanitation process of the user.

4. The device of claim 1, wherein the connection component comprises an extension section that extends in the direction orthogonal to the horizontal direction and that is configured to permit the brush component to connect to the connection component in a position that is laterally offset from the shaft component.

5. The device of claim 1, further comprising:

another brush component that is configured to connect to the connection component and that is disposed in the vertical direction, and wherein the brush component is disposed in the horizontal direction.

6. The device of claim 1, wherein the brush component includes a set of indents that permits the brush component to be removably connected to the connection component.

7. A system, comprising:

a handle component that is configured to permit a user to grasp the handle component during a sanitation process of a distal appendage of the user;

a shaft that extends in a vertical direction and that is configured to connect the handle component and a connection component;

the connection component that comprises a first portion and a second portion that extend in the vertical direction to form a space that is capable of accommodating the distal appendage of the user, and that is configured to adhere to a surface to permit the system to remain substantially stationary during the sanitation process; and a brush component that is configured to permit the user to perform the sanitation process of the user and that is connected to the first portion and the second portion of the connection component via friction fit, wherein the brush component extends laterally in a horizontal direction beyond the first portion and the second portion, and wherein the brush component is offset from the space in a direction orthogonal to the horizontal direction.

8. The system of claim 7, wherein the brush component is removably connected to the connection component.

9. The system of claim 7, further comprising:

another brush component that is configured to permit the user to perform the sanitation process and that is removably connected to the connection component.

10. The system of claim 7, further comprising:

a set of adherence components configured to removably adhere to the surface to permit the system to remain substantially stationary during the sanitation process.

11. The system of claim 7, wherein the connection component comprises an extension section that extends in the direction orthogonal to the horizontal direction and that is configured to permit the brush component to connect to the connection component in a position that is laterally offset from the shaft.

12. The system of claim 7, wherein the connection component is removably connected to the shaft.

13. A sanitizing apparatus, comprising:

a handle component that is configured to permit a user to grasp the handle component during a sanitation process of a foot of the user;

a shaft component that extends in a vertical direction and that is configured to connect the handle component and a connection component;

the connection component that comprises a first portion and a second portion that extend in the vertical direction to form a space that is capable of accommodating the distal appendage of the user, and that is configured to removably adhere to a surface to permit the sanitizing apparatus to remain substantially stationary during the sanitation process of the foot of the user; and a brush component that is configured to permit the user to perform the sanitation process of the foot of the user and that is removably connected to the first portion and the second portion of the connection component via friction fit, wherein the brush component extends laterally in a horizontal direction beyond the first portion and the second portion, and wherein the brush component is offset from the space in a direction orthogonal to the horizontal direction.

14. The sanitizing apparatus of claim 13, further comprising:

another brush component that is configured to permit the user to perform the sanitation process of the user and that is removably connected to the connection component.

15. The sanitizing apparatus of claim 13, further comprising:

a set of adherence components configured to removably adhere to the surface to permit the sanitizing apparatus to remain substantially stationary during the sanitation process.

16. The sanitizing apparatus of claim 13, further comprising:

another brush component that is configured to connect to the connection component and that is disposed in the vertical direction, and wherein the brush component is disposed in the horizontal direction.

17. The sanitizing apparatus of claim 13, wherein the connection component is configured to permit the user to place the foot of the user through the connection component.

* * * * *